United States Patent [19]

Penrice et al.

[11] Patent Number: 4,605,599

[45] Date of Patent: Aug. 12, 1986

[54] HIGH DENSITY TUNGSTEN ALLOY SHEET

[75] Inventors: Thomas W. Penrice, Juliet; James Bost, Mt. Juliet, both of Tenn.

[73] Assignee: Teledyne Industries, Incorporated, Los Angeles, Calif.

[21] Appl. No.: 805,701

[22] Filed: Dec. 6, 1985

[51] Int. Cl.[4] ..... B32B 15/00

[52] U.S. Cl. ..... 428/665; 75/84; 75/246; 75/248; 419/9; 419/28; 419/53; 419/54; 419/55; 419/58; 428/680; 428/681

[58] Field of Search ..... 428/665, 680, 681; 75/84, 246, 248; 419/9, 28, 53, 54, 55, 58

[56] References Cited

U.S. PATENT DOCUMENTS

| | | | |
|---|---|---|---|
| 2,455,804 | 12/1948 | Ransley et al. | 428/665 |
| 2,464,591 | 3/1949 | Larsen et al. | 428/665 |
| 3,175,903 | 3/1965 | Herron et al. | 428/665 |
| 3,254,995 | 6/1966 | Goodfellow et al. | 75/176 |
| 3,307,982 | 3/1967 | Milligan et al. | 148/133 |
| 3,318,696 | 5/1967 | Krock et al. | 75/208 |
| 3,449,120 | 6/1969 | Zdanuk et al. | 75/208 |
| 3,450,512 | 6/1969 | Maxwell | 428/665 |
| 3,888,636 | 6/1975 | Sczerzenie et al. | 29/182 |
| 3,929,424 | 12/1975 | Krock et al. | 29/182.1 |
| 3,979,209 | 9/1976 | Snyder, Jr. | 75/227 |
| 3,979,234 | 9/1976 | Northcut, Jr. et al. | 148/126 |
| 4,090,875 | 5/1978 | Ludwig | 75/248 |
| 4,105,828 | 8/1978 | Borchert et al. | 428/665 |
| 4,189,522 | 2/1980 | Mori | 428/557 |
| 4,332,617 | 6/1982 | Hovis, Jr. et al. | 75/214 |

*Primary Examiner*—Stephen J. Lechert, Jr.

*Attorney, Agent, or Firm*—Parmelee, Miller, Welsh & Kratz

[57] ABSTRACT

A method of producing a high density tungsten alloy sheet product is disclosed which utilizes as a starting material a thin-gage sheet or foil substrate of a first alloy constituent, such as pure iron or an alloy thereof. A prescribed mixture of tungsten metal powder and a second metal alloy constitutent powder, such as nickel, is loaded on the substrate and partially consolidated in a protective atmosphere furnace to form a porous tungsten alloy skeleton which is also partially bonded to the substrate. The product is then preferably cooled in a protective atmosphere and sheared into desired lengths. The sized pieces are then further heated in a protective atmosphere at gradually increasing temperatures to a point above the melting point of the substrate, whereupon the substrate sheet or foil melts and infiltrates the porous tungsten alloy skeleton to complete the densification of the product.

17 Claims, 2 Drawing Figures

HIGH DENSITY TUNGSTEN ALLOY SHEET

BACKGROUND OF THE INVENTION

The present invention relates generally to the manufacture of high density tungsten alloy sheet, and more particularly, to a method of producing such an alloy sheet product by first forming a thin sheet or foil substrate of a first alloy constituent or a mixture of alloy constituents and partially sintering a mixture of tungsten powder and a second alloy constituent powder thereon. Densification is by solid diffusion bonding and subsequently by liquid phase infiltration of the sheet or foil substrate into the tungsten alloy skeleton.

There is presently a need for substantial quantities of high density tungsten alloy in sheet form for such applications as aircraft components, radiation screens and shields in radiation detectors and the like. Unfortunately, full development of the application potentials for these products is being inhibited by the extremely high cost of manufacturing when using conventional press-liquid phase sinter-powder metallurgy techniques. Commonly used powder metallurgy processes are most cost effective in the production of relatively small components by pressing the metal powder mixture, usually by the isostatic technique, to a shape that nearly approximates the finished part so as to minimize the expense of further working or machining operations. It is also known in the art to make relatively large powder pressings to form compacted billets that are then sintered and subsequently rolled, pressed or otherwise worked into the required shape and size. This technique has been employed in the manufacture of sheet material but it has been found that high density tungsten alloys work harden very rapidly which necessarily requires costly multiple, high temperature anneals to reach a significant reduction in area and prepare sheets of a reasonable size. In an effort to minimize these costly procedures, it is known to press powder compacts with increased plan form dimensions and reduced thickness in order to thereby reduce the number of roll-anneal cycles necessary to reach the desired finished sheet dimensions. Unfortunately, economic limitations are quickly reached in this method of sheet manufacture, in that the increased load capacity of the compacting press causes a more rapid increase in investment costs and also results in a generally slower rate of operation. Additionally, and, perhaps, more serious is the increased difficulty experienced in material handling when transferring the large, fragile pressed compacts from the mold cavities to the densification or sinter furnace. Excess scrap generation and slow production rates are common drawbacks inherent in this press-sinter method of sheet manufacture. Attempts to add temporary binders to increase the strength of the "green" (un-sintered) pressed compacts has proved unsatisfactory due to the fact that the binder tends to poison the tungsten alloy by destroying ductility.

SUMMARY OF THE INVENTION

Accordingly, it is a primary object of the present invention to provide a method of manufacturing high density tungsten alloy sheet which avoids the relatively high expense and slow production rates prevalent in conventional powder metallurgy techniques. This object is achieved by providing a process which can be operated economically for the commercial manufacture of high density tungsten alloy sheet with minimum amounts of rolling or secondary shaping and the intermediate high temperature anneals heretofore required. More particularly, in the method of the present invention, a certain portion of the alloy composition is selected so as to have a relatively low work hardening coefficient and be amenable to moderate temperature annealing. This alloy constituent is readily rolled into a thin gage sheet or foil form with a minimum number of anneals and is used as a substrate to support a powder mixture of a second alloy constituent and tungsten. Densification is by solid diffusion bonding and subsequently by liquid phase infiltration at a higher temperature to cause melting of the substrate which then fills the voids of the tungsten alloy skeleton previously formed. In a preferred form of the invention, a two-phase alloy of tungsten is processed into sheet form by selecting the two alloying constituents according to their melting points and mutual solubilities. The alloy constituents are preferentially introduced into the process so that a lower melting point fraction of the composition, such as nickel, sinters in a powdered mixture with the tungsten at a temperature of about 1200° C., and a higher melting point fraction, such as pure iron or an iron-nickel alloy, in the form of the sheet or foil substrate, completes the densification by infiltration at a higher process temperature on the order of 1550° C. The tungsten dissolves in the nickel-iron alloy to a limited extent and for mixtures of these metals at temperatures about the liquidus for the system, there is a marked grain growth of tungsten into spheroids by known solution and re-precipitation mechanisms. A finished grain structure is developed which has excellent mechanical properties for certain applications, such as in aircraft components, radiation shielding and the like.

Other features and advantages of the present invention will become apparent to those skilled in the art upon an understanding of the following illustrative method when taken with the drawings and the appended claims.

DESCRIPTION OF THE DRAWINGS

The present invention will be better understood by reference to the accompanying drawings, in which.

DETAILED DESCRIPTION OF THE INVENTION

Figures 1, 2:
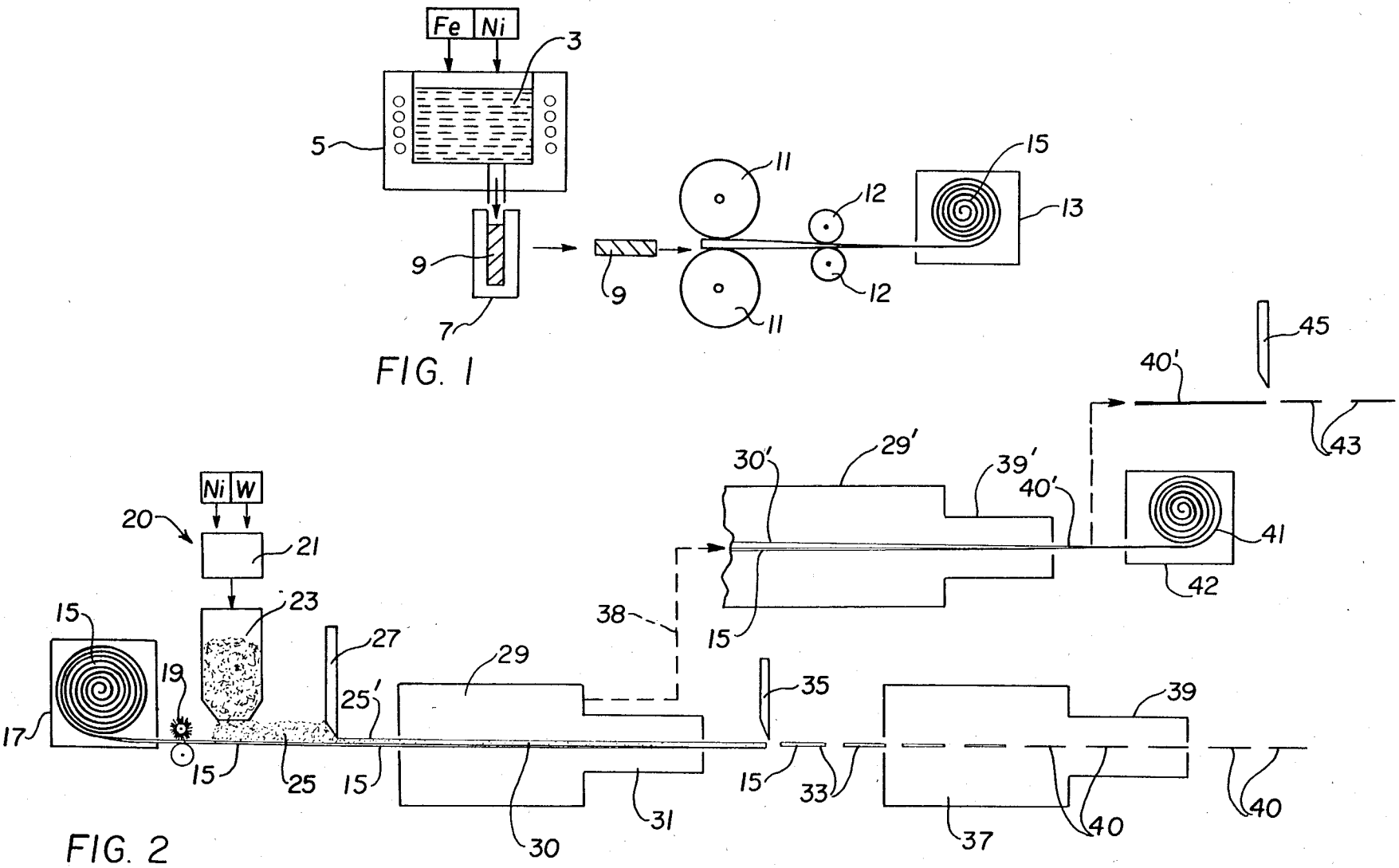
FIG. 1 is a schematic drawing of a casting and rolling line for the manufacture of a sheet or foil substrate for use in the present invention.
FIG. 2 is a schematic drawing of a manufacturing line suitable for practicing the present invention.

In a presently preferred embodiment of the invention, a two-phase, high density tungsten-nickel-iron alloy sheet was prepared having a finished thickness of 0.1 inches and a finished composition (weight %) of: 90% tungsten (W), 7% nickel (Ni) and 3% iron (Fe). In this alloy composition, it is noted that the melting points of the primary metals are as follows:

Tungsten: 3410° C.
Nickel: 1453° C.
Iron: 1535° C.

In practicing the invention, a thin sheet or foil substrate is first prepared from the matrix alloy constituent which has the higher melting point or from an alloy thereof, i.e., pure iron or an alloy of iron and nickel. Such an alloy can readily be rolled to thin sheet or foil form with minimum anneals. Referring to FIG. 1, pure iron is melted in a furnace 5 and a controlled amount of pure nickel is added to produce a molten bath 3 of iron-nickel alloy of a predetermined composition. In the above referred to tungsten alloy of 90% W, 7% Ni and 3% Fe, an iron-nickel alloy of 83% Fe and 17% Ni was prepared in the furnace 5 and then poured into a mould 7 to form a cast billet or slab 9. The slab 9 of iron-nickel alloy, due to its relatively low work hardening coefficient, is easily rolled into a thin gage sheet or foil through a train of rolls 11 and 12, in a conventional manner. The finished iron or iron-nickel alloy sheet may be received in a coiler device 13 which forms a coil of the finished alloy substrate material 15 therein. In the example, for a finished sheet of tungsten alloy of 0.1 inches in thickness, the iron-nickel substrate 15 is approximately 0.0024 inches thick. The actual thickness of the iron nickel substrate was calculated to have a weight per unit area equal to the weight of iron plus 17% nickel contained in the same unit of area of the finished sheet. Various thicknesses of finished, high density tungsten alloy sheet are, of course, possible utilizing the present invention, the only practical limitation being imposed by the very thin and fragile nature of the substrate foil. In this regard, thicknesses of finished tungsten alloy sheet down to a minimum of about 0.030 inches appear to be possible without substrate failure.

After the coiled substrate 15 of iron or iron-nickel alloy has been prepared it is moved to the process line schematically depicted in FIG. 2. The coiled substrate 15 is fed from an uncoiler device 17 to a powder loading station, generally designated 20. Prior to entry into the loading station 20, the surface of the substrate sheet or foil 15 is cleaned by conventional degreasing after rolling and further cleaned in a conventional hydrogen annealing furnace. The upper section of substrate 15 may also receive a treatment by a rotating wire brush 19 to insure a proper surface condition prior to the powder loading step.

Tungsten metal powder having a preferred particle size range of between about 3 to 5 microns, and preferably prepared by a hydrogen reduction process from an oxide of tungsten, is intimately mixed in a chamber 21 with a specific amount of nickel powder. The quantity of nickel powder is calculated to be equal to that part of the total nickel content of the finished alloy not included in the iron-nickel substrate 15. The nickel powder is preferably produced by the carbonyl process and, likewise, has a particle size range of between about 3 to 5 microns.

The continuous substrate sheet or foil 15 of iron-nickel alloy, pure iron, or other tungsten compatible alloy, is moved horizontally from the uncoiler device 17 to the loading station 20 wherein a layer of premixed tungsten and nickel powders 25 from chamber 21 are deposited thereon by way of a feed hopper 23. A vertically adjustible scraper blade 27 is positioned downstream from the loading station 20 and impinges upon the loaded powder layer 25 as the powder layer passes therebeneath. Scraper blade 27 functions to spread the powder uniformly across the width of the substrate 15 to form a finished green powder layer 25' of a predetermined height. The height of the powder layer 25' is, thus, adjustible by vertical movement of scraper blade 27 to control the actual weight of the tungsten and nickel alloy constituents in the final alloy composition. The height of the green powder layer 25', prior to densification, is roughly four times greater than the finished, fully densified tungsten alloy sheet for the powder particle sizes employed above. Hence, in the present example, for a desired finished sheet thickness of 0.1 inch, employing an 83:17 iron-nickel alloy substrate, the deposited layer 25' of tungsten and nickel powders would be approximately 0.4 inches in height. If desired, the powder layer 25' may be compacted slightly by rolls (not shown) prior to sintering, but it is usually not necessary due to the high density of the powders employed.

The substrate 15, with its premeasured layer of metal powders 25' uniformly loaded thereon, then proceeds slowly, on a roller conveyor or the like (not shown), to the entrance of a high temperature, controlled atmosphere, sintering furnace 29 for partial consolidation of the powder layer 25'. The furnace 29 contains a protective atmosphere of hydrogen ($H_2$) or like gas or gases and is controlled at a temperature of about 1200° C. Nickel is well known as an activator for sintering tungsten and at the prescribed temperature within furnace 29, the nickel and tungsten powders partially consolidate and, in addition, some bonding between the metal powders and the substrate 15 occurs. The residence time in the furnace 29 is about one hour at temperature so that a partially consolidated skeleton of tungsten-nickel alloy is produced which is partially bonded to the iron-nickel alloy substrate. This composite strip, designated 30, then preferably leaves the sintering zone of furnace 29 and enters a cooling zone 31. The cooling zone 31 also has a protective atmosphere of hydrogen or the like to avoid oxidation of the partially consolidated strip 30. Cooling in a protective atmosphere is quite critical due to the porous nature of the tungsten-nickel skeleton.

At this stage of the process, the partially consolidated strip 30 exits the cooling zone 31 and is cut into sized pieces 33 of any convenient length by a shear 35, or other cutting means. Alternatively, the strip 30 can be further processed in a continuous length, without the intermediate cooling or shearing steps, as indicated by the dashed line process path 38 shown in FIG. 2, which will be explained in greater detail hereinafter.

In a commercial production line for the manufacture of high density tungsten alloy sheet, it is generally preferred to shear the strip 30 into sized lengths for ease of handling due to the relatively great weight of the material. Commercially, the sheared pieces 33 of partially consolidated strip would be about ten feet long and approximately two feet wide. The partially sintered, composite pieces 33 are next moved into a high temperature, protected atmosphere furnace 37 which is capable of being heated to about 1550° C. The atmosphere within furnace 37 is also controlled and is preferably hydrogen ($H_2$). The sized pieces 33 are slowly heated past the 1200° C. level used in the first heat treatment within furnace 29 at which point the sintering or consolidation of the tungsten and nickel powder particles continues. The powdered nickel-tungsten mixture will sinter to an appreciable degree by the time the 1453° C. melting point of pure nickel is reached and exceeded. The solidus temperature will, of course, progressively increase as tungsten goes into solution in the nickel. As the temperature within furnace 37 gradually increases past the melting point of the iron-nickel alloy substrate 15, the alloy substrate is transferred into a molten liquid state and is drawn upwardly by infiltration into the voids of the partially consolidated, tungsten-nickel skeleton to complete the densification process. The residence time within the furnace 37 is about one hour at temperatures above 1550° C. It is known that tungsten dissolves in a nickel-iron alloy, to a limited extent, for a mixture of these metals at temperatures above the liquidus for the system, which is, of course, realized in the above example within the furnace 37. There is a marked grain growth of tungsten into spheroids, presumably by solution and re-precipitation mechanisms which develops a grain structure that exhibits excellent mechanical properties for certain sheet applications alluded to above. The fully densified pieces of finished high density tungsten alloy sheet, designated 40, pass from the densification/infiltration furnace 37 into a cooling zone 39 which may contain a protective atmosphere of hydrogen or a mixture of hydrogen and nitrogen, or like inert gas, or mixtures of such gases.

In the alternate process embodiment mentioned above and indicated by the dashed line 38 of FIG. 2, the thermal treatment of a continuous strip of material 30' is schematically represented. Instead of being cooled within the zone 31 and sheared into pieces 33, the partially consolidated strip 30' remains uncut and passes from furnace 29 into a continuing furnace portion 29'. The temperature within the furnace portion 29' increases gradually in zones, for example, from about 1200° C. to about 1550° C. permitting the material 30 to have a residence time at the higher temperature of about one hour to permit further consolidation by sintering of the tungsten-nickel powders and to permit the melting and infiltration of the substrate 15. As in the previously described process embodiment, the high temperature sintering/infiltration furnace portion 29' also contains a protective atmosphere of hydrogen, like that of its counterpart, furnace 37. Furnace portion 29' also contains a cooling zone 39' at its exit end which, likewise, includes a protective atmosphere similar to cooling zone 39. When the continuous, finished strip 40' leaves the cooling zone 39' it may be taken-up by a coiler device 42 and wound into coils 41, or it may be directed to a shear 45 and cut into sized sheets 43, depending on the later application and material handling requirements of the ultimate user. While the majority of the dimensional shrinkage due to the sintering/densification steps is in a vertical direction, i.e., across the thickness of the strip 30, there is also some shrinkage of the strip in the horizontal direction which must be accommodated for in any continuous process line which employs a take-up device such as the coiler 42. Various means for accommodating such horizontal shrinkage are well known in the hot strip rolling art and, therefore, need not be discussed in detail herein.

In the above-described example, the substrate 15 is made from a 83:17 iron-nickel alloy, which supplies all of the iron content and a portion of the nickel content in the finished 90:7:3 tungsten-nickel-iron alloy sheet. As previously mentioned, the substrate 15 can also be made from pure iron, in which case all of the nickel content in the finished sheet product would come from the nickel powder source at loading station 20. Also in keeping with the spirit of the present invention, other metals which are compatible with the iron group may be substituted. For example, cobalt or molybdenum may be partially substituted for nickel without harmful losses in ductility. In accordance with the invention the constituents are selected according to their melting points and mutual solubilities. The constituents are preferentially introduced into the process such that the low melting point fraction of the composition, such as nickel, sinters from a powder mixture with the tungsten and the higher melting point fraction, such as iron, functions as a carrier substrate for the powders during a first stage, partial densification. The substrate later completes the densification by melting and infiltration at a higher process temperature.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A process for the manufacture of high density tungsten (W) alloy sheet comprising the steps of:

selecting at least first and second alloy constituents, wherein each of said constituents have a melting point below that of tungsten and wherein the first constituent has a higher melting point than said second constituent;

forming a substrate in sheet or foil form containing as a major portion said first alloy constituent;

loading said substrate with a metal powder mixture containing predetermined amounts of tungsten powder admixed with powder particles of at least said second alloy constituent;

heating said powder mixture and said substrate to form a partially consolidated tungsten alloy skeleton partially bonded to the substrate;

further heating said partially consolidated tungsten alloy skeleton and said substrate to a temperature above the melting point of said substrate, whereby said substrate melts and infiltrates the tungsten alloy skeleton to complete the densification thereof.

2. The process of claim 1 wherein the first alloy constituent is iron (Fe) and the second alloy constituent is nickel (Ni).

3. The process of claim 2 wherein the substrate comprises substantially pure iron.

4. The process of claim 2 wherein the substrate comprises an alloy substantially of iron and nickel.

5. The process of claim 1 wherein the first alloy constituent is iron (Fe), the second alloy constituent is nickel (Ni) and the admixture of tungsten and nickel powders also contains a predetermined amount of metal powders selected from at least one of the group consisting of cobalt (Co) and molybdenum (Mo).

6. The process of claim 1 including the steps of cooling said partially consolidated tungsten alloy skeleton and substrate after said first heating step and cutting said cooled skeleton and substrate into premeasured lengths prior to said further heating step.

7. The process of claim 6 wherein the first heating step, the further heating step and the cooling step are conducted in a protective atmosphere.

8. The process of claim 7 wherein the protective atmosphere is hydrogen ($H_2$).

9. The process of claim 2 wherein the first heating step is conducted at a temperature of about 1200° C. and said further heating step is conducted at gradually increasing temperatures between about 1200° C. to about 1550° C.

10. The process of claim 9 wherein the residence time within the first heating step is about one hour commencing when the powder mixture has reached a temperature of about 1200° C., and the residence time within the further heating step is about one hour commencing when the substrate has reached a temperature of about 1550° C.

11. The high density tungsten alloy sheet product produced by the process of claim 1.

12. A process for the manufacture of high density tungsten alloy sheet comprising the steps of:

forming a substrate in sheet or foil form and containing iron (Fe) as a major portion of its composition;

loading said substrate with a metal powder mixture containing predetermined amounts of tungsten (W) powder admixed with powder particles of at least nickel (Ni);

heating said powder mixture and said substrate in a protective atmosphere at a temperature of about 1200° C. to form a partially consolidated tungsten-nickel skeleton partially bonded to the substrate;

further heating said tungsten-nickel skeleton and said substrate in a protective atmosphere and gradually increasing the temperature within a range of from about 1200° C. up to about 1550° C., whereby said tungsten and nickel particles further consolidate and said substrate melts and infiltrates said tungsten-nickel skeleton to complete the densification thereof; and cooling said densified tungsten-nickel-iron sheet in a protective atmosphere.

13. The process of claim 12 including the steps of cooling said partially consolidated tungsten-nickel skeleton and substrate in a protective atmosphere after said first heating step and cutting said cooled skeleton and substrate into premeasured lengths prior to said further heating step.

14. The process of claim 12 wherein the substrate consists substantially of pure iron.

15. The process of claim 12 wherein the substrate consists substantially of an alloy of iron and nickel.

16. The process of claim 12 wherein the admixture of tungsten and nickel powders also contains a predetermined amount of metal powders selected from at least one of the group consisting of colbalt (Co) and molybdenum (Mo).

17. The high density tungsten alloy sheet product produced by the process of claim 12.

* * * * *